United States Patent [19]

Steinman

[11] 4,172,579

[45] Oct. 30, 1979

[54] MAILBOX SUPPORT DEVICE

[76] Inventor: Arthur P. Steinman, Rte. 1, Box 99, Rib Lake, Wis. 54470

[21] Appl. No.: 856,355

[22] Filed: Dec. 1, 1977

[51] Int. Cl.[2] ..... B65D 91/00; E16M 13/00

[52] U.S. Cl. ..... 248/145; 232/39

[58] Field of Search ..... 232/39; 248/156, 145, 248/416–418

[56] References Cited

U.S. PATENT DOCUMENTS

| | | | |
|---|---|---|---|
| 954,588 | 4/1910 | Randall | 248/145 |
| 1,435,379 | 11/1922 | Connery | 248/145 |
| 1,645,768 | 10/1927 | Morten | 248/145 |
| 1,834,775 | 12/1931 | Hall | 248/145 |
| 2,149,050 | 2/1939 | Hajicek | 248/145 |
| 2,280,476 | 4/1942 | Calvert | 248/145 |
| 2,700,411 | 1/1955 | Lamb | 248/416 X |
| 3,229,940 | 1/1966 | Kagels | 248/145 X |
| 3,407,997 | 10/1968 | Wood et al. | 232/39 |
| 3,899,150 | 8/1975 | Racquet | 248/145 |
| 3,999,702 | 12/1976 | Conroy | 248/145 |

FOREIGN PATENT DOCUMENTS

| | | | |
|---|---|---|---|
| 651435 | 10/1962 | Canada | 248/156 |

*Primary Examiner*—Francis K. Zugel

*Attorney, Agent, or Firm*—Williamson, Bains, Moore & Hansen

[57] ABSTRACT

A mailbox support device is provided having an upright post inserted in the ground by means of auger teeth and secured by a stabilizing plate. The support includes a mailbox arm rotatably mounted on the post. The arm is mounted for rotation about the post and can assume a plurality of stable retained positions. The rotational motion is allowed even under extremes of winter weather and permits the mailbox arm to be positioned overhanging the edge of a street or road for easy access while allowing it to be rotated out of the way of oncoming snowplows and other vehicles.

5 Claims, 6 Drawing Figures

MAILBOX SUPPORT DEVICE

BACKGROUND OF THE INVENTION

This invention relates to the field of mailbox support devices and provides a structure by which a mailbox may be rotatably positioned and retained.

In many rural and suburban areas, mail is delivered to mailboxes which must be located along streets or roads. The mailbox must often be accessible to a mail carrier working from a delivery vehicle, and it is desirable that the mail carrier be able to place mail in the mailbox without leaving the vehicle. The mailbox should remain in place even when heavily loaded with mail. During the winter, mailboxes positioned for the convenience of mail carriers may protrude into the path of snowplows endeavoring to clear the streets or roads of snow accumulations, and not uncommonly mailboxes are struck and damaged by passing snowplows. This problem may be solved by providing a mailbox which can manually swing between a first position convenient for the delivery of mail and a second position well out of the path of passing snowplows. The mailbox should remain securely in either position and not be moved by the wind or other extraneous influences. It is desirable, however, that the mailbox be releasably retained so that it is able to rotate if struck by a passing vehicle.

A shortcoming of known mailbox supports is their inability to allow the mailbox to reliably assume stable alternate positions. This shortcoming becomes particularly apparent during extremes of winter weather when exposed mechanisms and components become encrusted and jammed with ice or snow, and many presently known devices have exposed operating parts which are easily rendered inoperative by the elements. It is a purpose of the present invention to provide a mailbox support which alleviates many of the previous difficulties.

BRIEF SUMMARY OF THE INVENTION

A general object of the present invention is to provide a mailbox support device which can be positioned closely adjacent a road, placed in a first position projecting outwardly toward the road, and capable of rotation to a stable alternate position clear of vehicles using the road. The device includes an arm capable of holding a mailbox, and the arm is attached to a rotating section which is mounted atop a hollow post. The rotating section and the post are connected by a positioning apparatus which allows the section to rotate about the post between two or more predetermined positions. The positioning apparatus includes a notched sleeve secured to the rotating section and a pin secured to the post. When assembled, the sleeve slides inside the post and contacts the transversely mounted pin. Separation between the rotating section, the post, and the sleeve is kept small to prevent the incursion of snow and ice. A spring acts to force the notched end of the sleeve against the side of the pin. The sleeve moves as the arm does since both are joined to the rotating section. As the arm moves, the sleeve rotates about its axis. When the notches of the sleeve align themselves with the pin, the sleeve is urged toward the pin by the spring. The sleeve notches act as cams with respect to the pin. The depth of the sleeve notches and the spring stiffness determine the force necessary to unseat the pin from the sleeve notches. Therefore, the cooperation between the sleeve notches, the pin, and the spring reliably holds the arm in a stable position. A plurality of stable arm positions can be provided by notching the lower end of the sleeve in an appropriate manner.

A feature of the present invention resides in the fact that the lower portion of the post is adapted to be inserted in the ground by a set of auger teeth. The post may be rotated about its axis, allowing the teeth to dig into the earth and sink the post into the ground. After insertion, the post is stabilized in the ground by a plate anchored thereto which prevents rotation and other movement of the post in the ground.

Another feature of the present invention involves the pivot apparatus connecting the mailbox supporting arm to the rotatable section. Pivoting action allows the mailbox to be positioned at a variety of vertical angles and elevation. This provides mailmen with easy access to the mailbox and ensures that the mailbox can be reached. A chain attached to the arm and extending to the rotating section provides the needed vertical stability to the mailbox. A cap mounted atop the rotating section has a slot which can cooperate with a slot in the rotating section to trap a length of the chain therebetween. Thus, varying lengths of chain may be used, and changing the length of the chain varies the angle of inclination of the arm.

These and other objects and novel features of the present invention will be more clearly and fully set forth in the following specification and claims.

DESCRIPTION OF THE PREFERRED EMBODIMENTS

Figure 1:
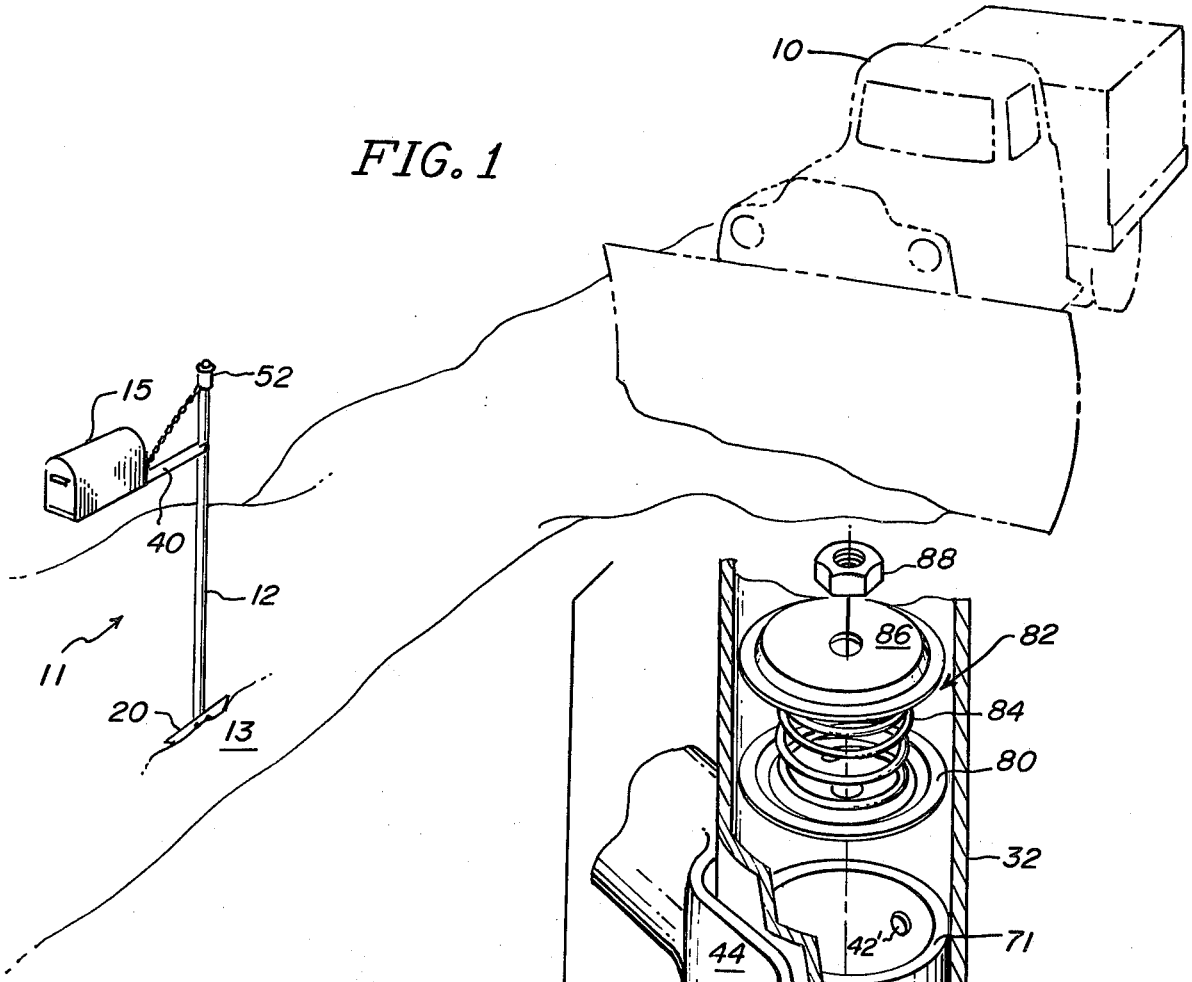
FIG. 1 is a perspective view showing an embodiment of the mailbox support invention in an environment in which it may be used.

The mailbox support device 11 illustrated in FIG. 1 of the drawing includes an upright, elongated, preferably hollow metal post 12 adapted to be anchored in the ground 13 and stabilized by the plate 20. A mailbox 15 is shown mounted on the arm 40. The mailbox support device is topped by a cap 52, and is shown as being next to a road or street. The mailbox is shown in FIG. 1 positioned so as to be clear of the oncoming snowplow 10.

Figure 2:
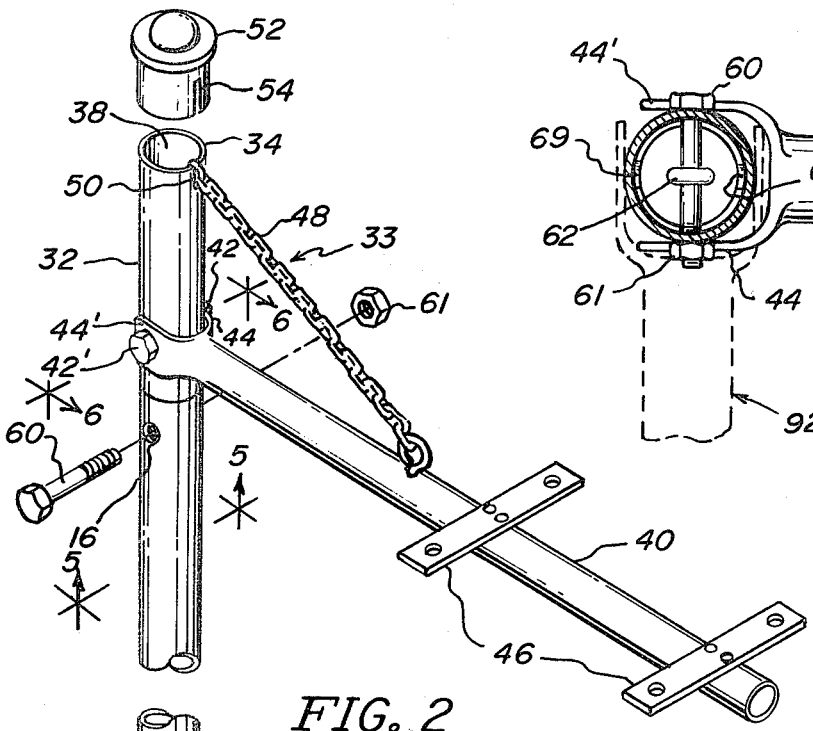
FIG. 2 is a partially exploded perspective drawing showing an embodiment of the mailbox support invention.

As shown in FIG. 2 of the drawings, the post 12 has its lower end provided with teeth 14 so that when the post 12 is rotated about its longitudinal central axis, it can be forced into the ground much like a screw. The post 12 has a transverse bore 16 which extends wholly through the post and which serves several purposes, the first of which is to permit a rigid bar (not shown) to be placed in the bore to permit a workman to easily rotate the post about its axis while screwing it into the ground. After the post 12 is inserted in the ground, the bar is withdrawn and the pin 60 is inserted through the bore 16 and secured by the nut 61 as described further hereafter.

Adjacent the lower end 31 of the post, a rigid, flat, preferably triangular plate 20 is driven into the ground and rigidly fixed to the post 12 by means of a bracket 22 which passes about the post 12 and extends through apertures 24 of plate 20 and threadably receives nuts 26. The plate 20 is positioned with its upper edge 28 parallel to the surface of the ground and approximately even therewith, and the plate 20 prevents post 12 from rotating about the post axis. In addition, the plate 20 has its plane generally parallel to the direction of the roadway so that the weight of a heavily loaded mailbox will not tend to incline the post 12 toward the roadway. Accordingly, the plate 20 provides stabilization to keep the post 12 in an upright orientation.

A generally cylindrical, hollow section 32 having upper and lower ends 34 and 36, respectively, is mounted atop the post 12 in a manner to be described further hereafter, and an arm 40 is swingably mounted to the section 32 by a pivot apparatus 33 including a pair of screws 42, 42' which pass through the ears 44, 44' of the arm 40. Crossbars 46 are fixed to arm 40 to receive and retain the mailbox 15. A chain 48 extends from the arm 40 to the upper end 34 of the section 32 and is retained in a slot 50, the excess chain 48 being stored within the hollow interior 38 of section 32. Accordingly, the angular orientation relative to the vertical of the arm 40 may be increased or decreased by taking in or playing out links of chain 48, depending on the optimum angle for mail reception. The screws 42, 42', and ears 44, 44' collectively comprise one type of pivot apparatus 33 useable with the invention. The cap 52 has a vertical slot 54 and fits over the upper end 34 of the section 32, the slot 54 cooperating with the slot 50 to trap the chain 48 therebetween.

Figure 3:
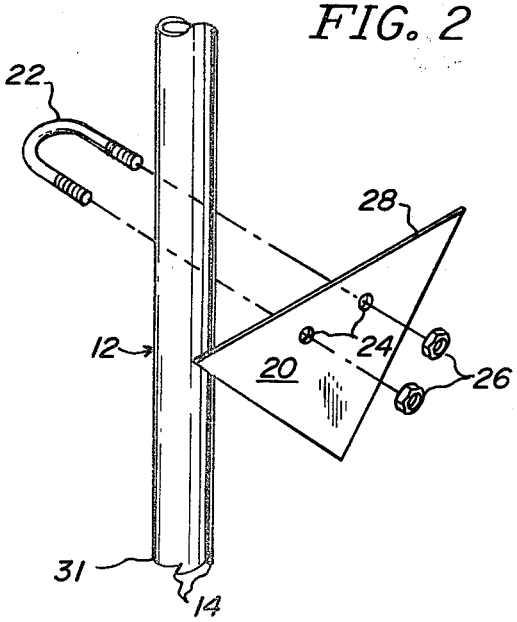
FIG. 3 is a perspective view of the lower end of the embodiment of FIG. 2.
Figure 3:
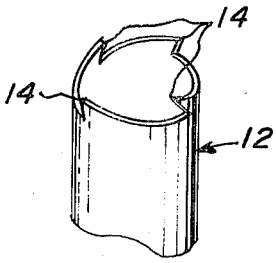

The construction of the lower end 31 of the post 12 is indicated by FIG. 3. A plurality of teeth 14 are circumferentially spaced along the lower end of the post 12 and act to cut into the earth when the post 12 is rotated about its axis.

Figure 6:
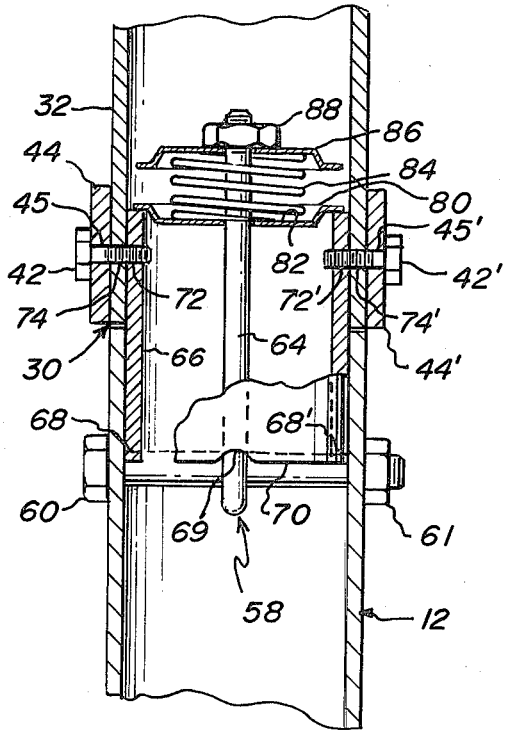
FIG. 6 is a cross sectional view of the embodiment of FIG. 2 taken from the direction of the arrows 6—6.

Referring now to FIG. 6, a positioning apparatus 58 rotatably mounts the section 32 on the post 12. After the post 12 has been rigidly fixed in the ground, a rigid, straight, generally horizontal pin 60 is passed through the post 12 and secured by nut 61. A rod 64 described further hereafter, is mounted on the pin 60 and extends upwardly out of the upper end 30 of the post 12 and into the section 32.

A generally cylindrical, rigid metal sleeve 66 is slidably inserted in the post 12 and extends upwardly into the section 32, a straight shaft 63 of the rod 64 extending coaxially with the sleeve. The lower sleeve end 70 of the sleeve 66 has four detents 68, 68', 69, 69' spaced 90 degrees apart, pairs of which engage the pin 60.

Adjacent the upper end 71 of the sleeve 66, are threaded apertures 72, 72' which communicate with the apertures 74, 74' in the section 32 and with the apertures 45, 45' in the ears 44, 44' of arm 40. The screws 42, 42' pass through the ears 44, 44' and thread into the apertures 72, 72'.

At the upper end 71 of the sleeve 66, a washer 80 has a depressed center 82 in which a coil spring 84 is received and retained. An identical washer 86 retains the remaining end of the spring 84 and a nut 88 is threaded onto the shaft 63 of rod 64 to compress the spring and to urge the sleeve 66 downwardly towards the pin 60. The washers 80 and 86 and spring 84, collectively comprise one type of resilient structure useable with the invention to urge sleeve 66 towards pin 60. Accordingly, the nut 88 can be tightened sufficiently to keep the sleeve 66 springloaded against the pin 60 with the detents 68, 68' or 69, 69' releasably retaining the sleeve in any one of four different angular positions.

Figure 4:
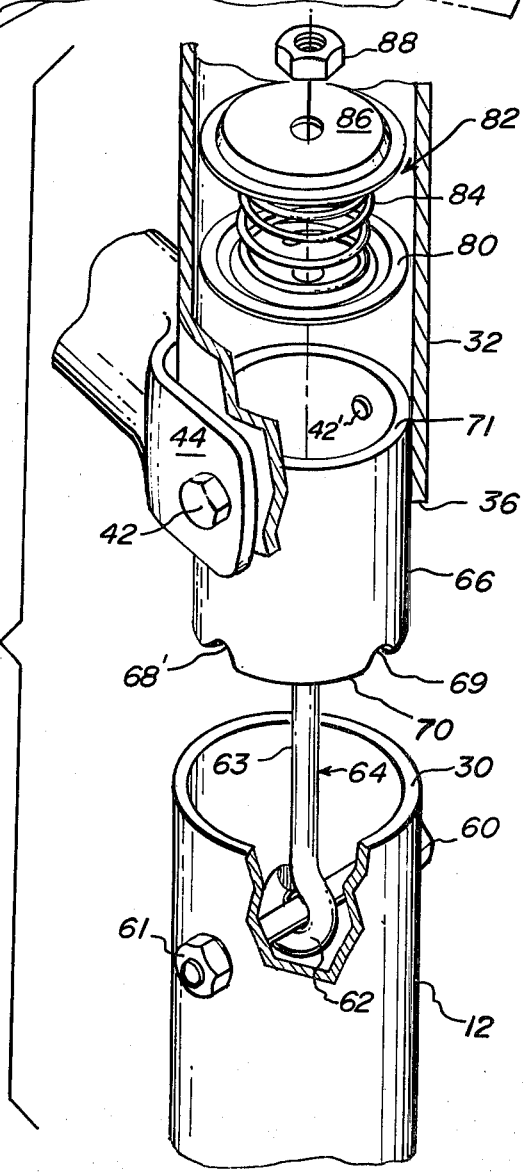
FIG. 4 is a partially exploded perspective drawing of the embodiment of FIG. 2 showing the positioning apparatus.

Another view of the positioning apparatus 58 is presented in FIG. 4 where the various parts are shown disassembled. The rod 64 is retained on the pin 60 by means of a hook-shaped end or eye 62, and pin 60 provides a support apparatus for the sleeve 66. The bolts 42, 42' slip through the ears 44, 44' of arm 40 and through the section 32 to thread into the sleeve 66. The washer 80 rests on the arm of the upper end 71 of the sleeve 66 and a coil spring 84 is retained between the washer 80 and the washer 86. The washer 80, the washer 86, and the spring 84 are adapted to allow rod 64 to pass upwardly therethrough. The washer 86 is restrained by the nut 88 which is attached to the rod 64. The pin 60, nut 61, rod 64, sleeve 66, washers 80 and 86, spring 84 and nut 88 collectively comprise one type of positioning apparatus 58 useable with the invention.

In operation, the mailbox support device 11 is positioned by a roadside with the post 12 being in an upright generally vertical orientation and with the plate 20 being rigidly imbedded in the earth to provide additional stability and support for the post 12.

Figure 5:
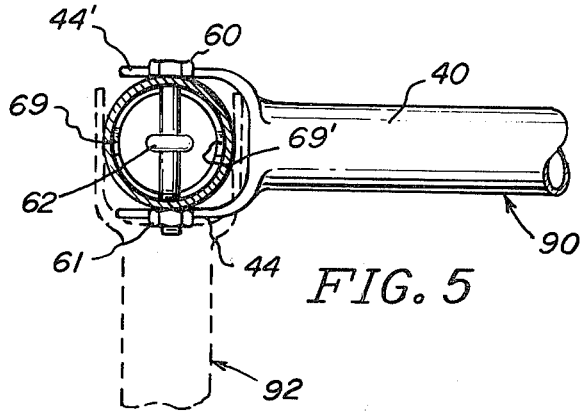
FIG. 5 is a cross sectional view of the embodiment of FIG. 2 taken from the direction of the arrows 5—5.

Under most conditions, it will be desirable to have the arm 40 extending toward the roadway and oriented generally perpendicular to the road edge as shown by position 90 of FIG. 5. Such positioning permits a mail carrier traveling in a delivery vehicle to easily insert mail into the mailbox 15. To insure that the mailbox is oriented at an optimum inclination to the vertical, the operator may raise or lower the arm 40 by means of shortening or lengthening, respectively the chain 48 which extends between the arm 40 and the section 32. Such lengthening or shortening is easily accomplished by inserting the desired link of the chain 48 into the generally vertical slot 50 in section 32 and then placing the cap 52 over the upper end of the section 32 with the slot 54 communicating with the slot 50 to trap the chain 48 therebetween. Depending upon the height of the delivery vehicle, the arm 40 may best be inclined downwardly below the horizontal or upwardly from the horizontal to obtain maximum accessibility for the mail delivery vehicle.

When the arm 40 is in the position 90 directed toward the roadway, the arm is retained rigidly and stably in the position 90 by engagement of the sleeve 66 and pin 60. The cooperating detents 68 and 68' or 69 and 69' rest upon and closely engage the shaft of the pin 60 with the spring 84 urging the sleeve downwardly into tight engagement with the pin thereby retaining the arm 40 in the position 90.

When weather conditions or snow accumulation make it advisable to swing the arm 40 to a second position 90 clear of the roadway so as to avoid or eliminate danger from plows, the operator grasps the arm 40 and swings it through approximately 90 degrees to the position 92 (FIGS. 1 and 5). As the operator swings the arm 90, the sideward movement of the arm 40 generates an upward force component on the sleeve 66 causing the sleeve to move upwardly toward the spring 84 which is further compressed by such upward movement and resulting in the detent moving upwardly clear of the pin 60. The sleeve 66 now swings with the section 32 and arm 40 through approximately ninety degrees of arc until the next pair of detents encounter the pin 60 and are urged downwardly onto and against the pin by the downward restoring force of spring 84. This restoring force results in the sleeve 66 engaging and securely latching itself against the pin 60 to stably retain the arm 40 in the second position 92 clear of the roadway. The lower end of the section 32 mates closely and smoothly with the upper end 30 of the post 12 with the spring 84 urging the section 32 against the rim 30 of post 12. This tight interface between the post and the section is highly effective to keep the ice, snow and moisture from entering the interior of the support device thereby eliminating the problems of freezeup and jamming which might otherwise reduce effectiveness of the support device.

While the invention has been shown with a sleeve having four detents, it should be understood that additional pairs of detents could be utilized if desired to provide intermediate stable positions for the mailbox support post, and all such variations are within the purview of the invention.

Accordingly, it will be seen that the present invention provides a substantially improved mailbox support device which is highly resistant to the elements while being extremely reliable in all extremes of weather and relatively inexpensive to manufacture and produce.

While the preferred embodiments of the present invention have been described, it should be understood that various changes, adaptations and modifications may be made therein without departing from the spirit of the invention and the scope of the appended claims.

What is claimed is:

1. A rotatable mailbox support device capable of swingably supporting a mailbox during extremes of weather comprising:

an upright post capable of being anchored in the earth, having an upper post end and a lower post end;

a section having an upper section end and a lower section end;

a positioning apparatus attached to said post, adapted to rotatably support said section, allowing rotation of said section about an upright axis, capable of allowing said section to assume a plurality of stable rotational positions, and being substantially enclosed and surrounded by said section and said post;

an arm member capable of supporting a mailbox;

means for attaching said arm member to said section;

said positioning apparatus further including:

a sleeve fixed relative to said lower section end and capable of being insertably mounted in said upper post end, and having a lower sleeve end projecting from said section;

a rod member retained relative to said post, mounted within said post, and projecting upwardly from said upper post end;

support apparatus mounted inside said post, adapted to support said lower sleeve end during rotation of said section, and adapted to cooperate with said lower sleeve end to produce said plurality of stable rotational positions; and a resilient structure mounted inside said section and retained relative to said rod member to urge said sleeve towards said support apparatus;

said support apparatus further including a pin mounted transversely inside said post and attached to said rod member.

2. The mailbox support device of claim 1 wherein said resilient structure comprises:

a first washer supported by said section;

a helical spring supported by said first washer;

a second washer supported by said spring; and means for restraining said second washer on said rod member, said restraining means being capable of compressing said spring and forcing said sleeve towards said pin.

3. A rotatable mailbox support device capable of swingably supporting a mailbox during extremes of weather comprising:

an upright post capable of being anchored in the earth, having an upper post end and a lower post end;

a section having an upper section end and a lower section end;

a positioning apparatus attached to said post, adapted to rotatably support said section, allowing rotation of said section about an upright axis, capable of allowing said section to assume a plurality of discrete stable rotational positions located at predetermined angular orientations of said section, and being substantially enclosed and surrounded by said section and said post;

an arm member capable of supporting a mailbox;

a pivot apparatus connecting said arm to said section, and allowing said arm to move in a vertical plane;

a chain attached to said arm and extending to said upper section end; and a cap capable of mounting upon said upper section end, and capable of trapping said chain between said cap and said section.

4. A rotatable mailbox support device capable of swingably supporting a mailbox during extremes of weather comprising:

an upright post capable of being anchored in the earth and having an upper post end and a lower post end;

a section having an upper section end and a lower section end;

a sleeve fixed relative to said lower section end and capable of being insertably mounted in said upper post end, and having a lower sleeve end projecting from said section;

a rod member retained relative to said post, mounted within said post, and projecting upwardly from said upper post end;

support apparatus mounted inside said post, adapted to support said lower sleeve end during rotation of said section, and adapted to cooperate with said lower sleeve end to produce a plurality of discrete stable rotational positions located at predetermined angular orientations of said section; and a resilient structure mounted inside said section, retained relative to said rod member and urging said sleeve towards said support apparatus so as to insure the rotational stability of said plurality of positions located at predetermined angular orientations of said section and so as to prevent said sleeve from becoming inadvertantly dismounted from said post.

5. The mailbox support device of claim 4 wherein said resilient structure includes:

a first washer supported by said section;

a helical spring supported by said first washer;

a second washer supported by said spring; and means for restraining said second washer on said rod member.

* * * * *